US005186392A

United States Patent [19]

Pleshek

[11] Patent Number: 5,186,392

[45] Date of Patent: Feb. 16, 1993

[54] LIQUID-APPLYING DEVICE FOR CLEANING WALL AND CEILING SURFACES

[75] Inventor: Mark Pleshek, Milwaukee, Wis.

[73] Assignee: Von Schrader Company, Racine, Wis.

[21] Appl. No.: 837,731

[22] Filed: Feb. 19, 1992

[51] Int. Cl.[5] ..... B05B 15/06

[52] U.S. Cl. ..... 239/532; 134/172; 15/144.1; 15/144.4; 401/289

[58] Field of Search ..... 239/532, 530, 525, 280–281; 134/172, 198; 15/144 B, 144 R; 401/289, 140

[56] References Cited

U.S. PATENT DOCUMENTS

| | | | |
|---|---|---|---|
| 843,585 | 2/1907 | Cole | 239/532 |
| 3,881,209 | 5/1975 | Reinitz et al. | 15/102 |
| 3,915,382 | 10/1975 | Davis | 239/532 |
| 4,202,068 | 5/1980 | Lester et al. | 15/28 |
| 4,204,292 | 5/1980 | Lester et al. | 15/28 |
| 4,270,238 | 6/1981 | Shallenberg et al. | 15/321 |
| 4,412,656 | 11/1983 | Beck | 239/532 |
| 4,989,295 | 2/1991 | Guhne et al. | 15/410 |
| 5,037,028 | 8/1991 | Evans | 239/532 |

FOREIGN PATENT DOCUMENTS

| | | | |
|---|---|---|---|
| 652781 | 2/1963 | Italy | 239/281 |
| 89/11574 | 11/1989 | PCT Int'l Appl. | 239/281 |

*Primary Examiner*—Andres Kashnikow
*Assistant Examiner*—Karen B. Merritt
*Attorney, Agent, or Firm*—Jansson & Shupe, Ltd.

[57] ABSTRACT

The invention is an improvement in an extendable elongate liquid-applying device of the type used for cleaning interior walls and ceilings. The improvement includes first and second tubular members telescoped together and slideable relative to one another to extend and retract the device. One of the members has a proximal end; the other has a distal end and an attached angularly-oriented nozzle. A continuous length of coiled flexible hose extends within the members and connects to the nozzle member. That is, the hose extends unbroken along the lengths of the members, from the proximal end to the distal end, to provide discharge from the nozzle member regardless of the relative positions of the members. A separate base member plugs into the proximal end and has a valve for controlling liquid flow. With a nozzle attached thereto, the base member can be used alone for "close in" cleaning.

8 Claims, 1 Drawing Sheet

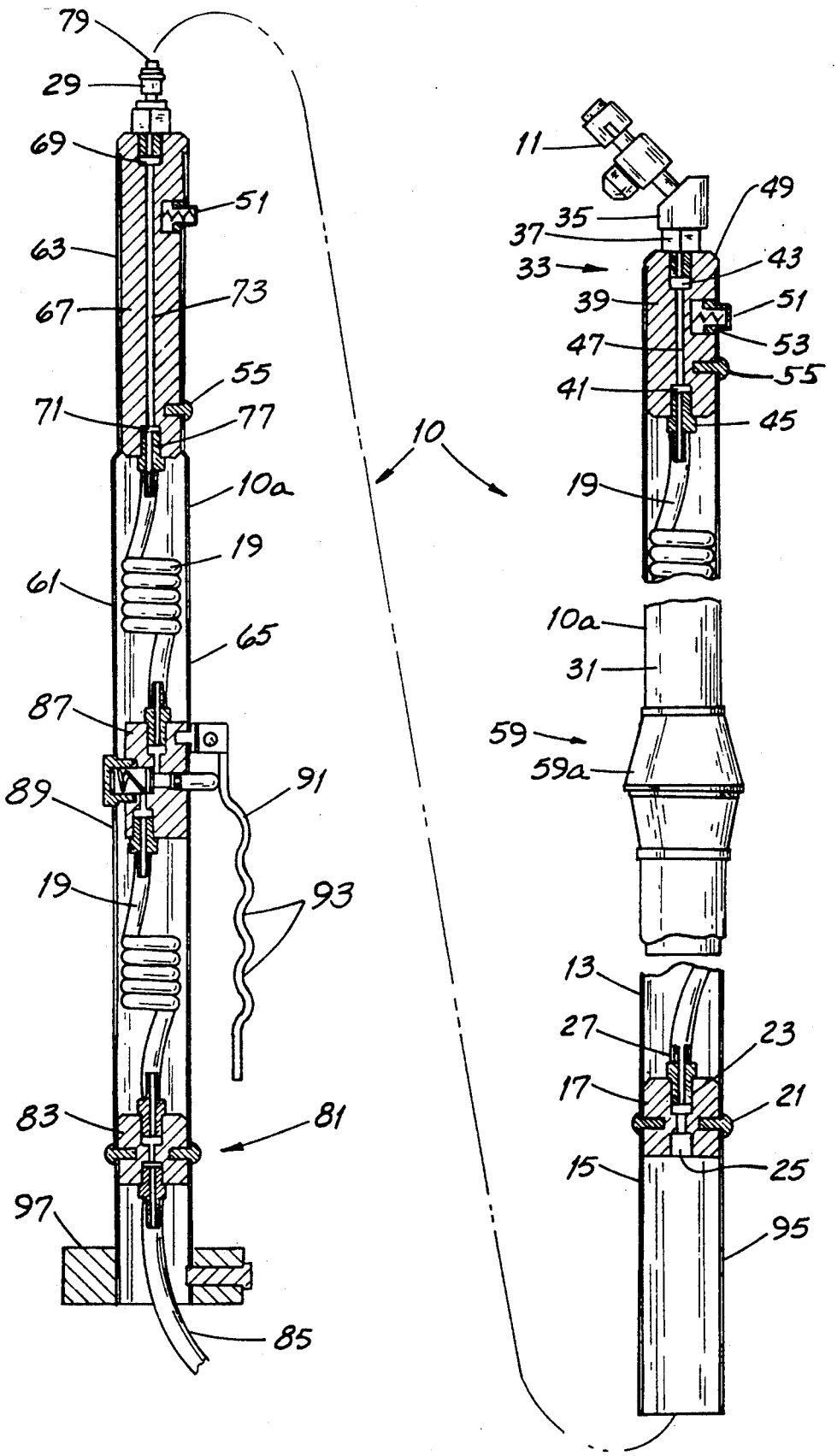
79
29
69
51
63
67
73
55
71
77
10
10a
19
61
65
87
91
89
19
93
83
81
97
85
11
49
35
37
43
33
39
51
47
53
55
41
45
19
10a
31
59
59a
13
27
23
17
21
15
25
95

LIQUID-APPLYING DEVICE FOR CLEANING WALL AND CEILING SURFACES

FIELD OF THE INVENTION

This invention is related generally to cleaning and, more particularly, to tools used to clean interior building surfaces.

BACKGROUND OF THE INVENTION

Certain cleaning operations, particularly those involving cleaning of commercial and institutional ceilings and walls, are often performed by professional cleaners using specialized equipment designed for the task. Clearly, such equipment has a significant impact upon the thoroughness of the cleaning operation and upon the ease and efficiency with which workers perform it. And the equipment must be reliable—failures and downtime are disruptive.

While the products of earlier designers of cleaning tools have been generally satisfactory, they are characterized by certain disadvantages. For example, in a tube-like extendable device, a way to provide pressurized liquid from its proximal end to the nozzle at the distal end is to fill the entire device with such liquid. In effect, the device becomes its own hose.

For telescoping devices, so-called "dynamic" seals (e.g., sliding or rotating seals) are required to seal in liquid and avoid leaks even though device components move with respect to one another. Such seals are significantly more complex than static seals.

Where the device includes rigid, telescoping tubes providing the user with a substantial "reach," the weight of the confined liquid becomes significant. The user is apt to tire more quickly. And device disassembly and storage becomes a problem since it must first be emptied of liquid.

Another disadvantage of some prior art tools is that they fail to recognize that tool users may clean areas very near by or at some considerable distance away. Certain of such tools fit one situation or the other—but not both.

Examples of prior art tools (not necessarily having the above-noted deficiencies) are described in the following patents. U.S. Pat. No. 4,202,068 (Lester) shows a pneumatically-powered scrubbing tool fed by a straight length of compressed air supply hose. An extension support pole fits over the main support pole and can be extended to a preselected position. The entire extension pole is rotated to lock relative pole positions.

U.S. Pat. No. 4,989,295 (Guhne et al.) describes a telescopic wand having a short, coiled internal electrical cable which accommodates extension. The two tubes can be positionally adjusted one to the other in steps.

U.S. Pat. No. 4,270,238 (Shallenberg et al.) shows a cleaning tool particularly adapted to ceiling and wall cleaning. The tool is a "dual-path" structure in that it applies a cleaning liquid through a brush and almost immediately after application, draws dirty liquid away using a vacuum-induced air stream.

U.S. Pat. No. 3,881,209 (Reinitz et al.) shows a machine for spray cleaning ceiling tiles by feeding them through the machine after they are removed from their mounting grids.

OBJECTS OF THE INVENTION

It is an object of this invention to provide an improved liquid-applying device overcoming some of the problems and shortcomings of devices of the prior art.

Another object of this invention is to provide an improved liquid-applying device which is relatively light in weight.

Another object of this invention is to provide an improved liquid-applying device which is easy to manipulate, even when fully extended.

Still another object of this invention is to provide an improved liquid-applying device obviating the need for dynamic seals.

Yet another object of this invention is to provide an improved liquid-applying device useful in cleaning surfaces "close in" and farther away from the device user.

Another object of this invention is to provide an improved liquid-applying device having an overall length adjustable in a continuum to any of an infinite number of positions.

How these and other important objects are accomplished will become more apparent from the following descriptions taken in conjunction with the drawing.

SUMMARY OF THE INVENTION

The invention is an improvement in an extendable elongate liquid-applying device. An example of such a device is a spray pole for applying cleaning solution to and cleaning inside surfaces, e.g., walls and ceilings, of buildings. The invention is particularly useful in cleaning acoustical tile ceilings and may be adapted to clean walls, as well.

The improvement includes a first tubular member having a proximal end and a second tubular member which is telescopingly engaged with and slideable along the first member. Sliding the second member extends and retracts the device for storage or cleaning and to meet particular work needs.

The second tubular member has a distal end with a nozzle member secured at such end. A coiled flexible hose extends within the first and second tubular members and connects to the nozzle member. The hose extends unbroken along the length of the first and second tubular members, from the proximal end to the distal end, to provide discharge from the nozzle member regardless of relative positions of the tubular members.

In using the improved device, it is usually desirable to first adjust and then "lock" the overall length of the telescoped members. To that end, the device includes means such as a twist-type locking collar to hold the tubular members together at a selected length of extension. And since in the preferred device both members are smooth-surfaced and unbroken by position-selecting notches, grooves or the like, the tubular members may be secured together at an infinite number of relative positions. In other words, the overall length of the members is adjustable in a continuum rather than in discrete increments.

One end of the hose, that nearer the device user, is secured to the proximal end of the first tubular member and, specifically, to a coupler at such end. The hose extends along both members and that hose end farther from the user is secured to an adapter at the distal end of the second tubular member.

In cleaning operations, the device user has occasion to control the flow of liquid and turn it on and off. And the members alone may not have sufficient length (even when fully extended) for some tasks. Therefore, the device further includes an elongate, tube-like base member. Its output end is connected to the proximal end of the first tubular member to provide a source of fluid to the hose.

The base member has an input end for attachment of a liquid supply line from a pump. A valve is mounted at the middle portion of such base member and has a trigger member whereby the operator can control output of liquid.

In cleaning situations requiring the operator to "reach out" with a fully extended (or nearly fully extended) device, a good deal of the device weight is forward of the operator's hands. Under those conditions, using the device can be tiring. Therefore, the device also includes a weight member removably secured to the base member near the input end. The weight of the tubular members may thereby be counterbalanced when the device is gripped by the base member middle portion. It is likely that the weight member may not often be required since the weight of the hose (and, often, the tension on it) serve much the same purpose as a counterweight.

For "close-in" cleaning, users need not employ the entire device. The base member is removably connected to the proximal end of the first tubular member and may be removed, fitted with a spray adapter and used alone for direct and nearby application of liquid. Further details of the invention are set forth in the detailed description taken in conjunction with the drawing.

BRIEF DESCRIPTION OF THE DRAWING

The figure is a side view of the improved device with parts shown in cross-section and other parts broken away.

DETAILED DESCRIPTIONS OF THE PREFERRED EMBODIMENTS

The figure shows the improved extendable elongate liquid-applying device 10, e.g., a spray pole 10*a* for applying cleaning solution to and cleaning walls and ceilings of buildings. As described in detail below, the length of the device 10 is adjustable and its angled spray nozzle member 11 is optimally oriented to spray cleaning solution on the ceiling surface. The device 10 is particularly useful in cleaning acoustical tile ceilings which tend to be damaged by wiping contact. The device 10 may also be adapted to be fitted to a glider pad to moisten the pad for cleaning walls.

The improvement includes a first tubular member 13 having a proximal end 15 and a coupler 17 mounted at such end for connection of a coiled, flexible hose 19. The cylindrical coupler 17 has an outside diameter selected to fit within the member 13 with sliding clearance and is held in place with screws 21. The coupler 17 has two cavities 23, 25, one each to receive, respectively, a threaded, barbed hose connector 27 and a spring-biased, valve-like disconnect fitting 29, the latter as further described below.

The device 10 also has a second tubular member 31 which is telescopingly engaged with and slideable along the first member 13. In the highly preferred embodiment, the outside diameter of the second member 31 is selected to fit within the member 13 with sliding clearance. However, the members 13, 31 Can be "positionally reversed" with the second member 31 sliding along the outside of the first member 13. Sliding the second member 31 inward or outward with respect to the first member 13 retracts or extends the device 10 for storage or for cleaning and to meet particular work needs.

The second tubular member 31 has a distal end 33 with a nozzle member 11 secured at such end 33. More particularly, the nozzle member 11 is attached to and extends from the angled face of an adapter body 35. When so arranged, the nozzle member 11 directs a spray of cleaning solution toward the ceiling when the device 10 is held at an upwardly-angled orientation and operated by a user standing on the floor.

In turn, the body 35 is attached to an O-ring-sealed disconnect fitting 37 threaded into a generally cylindrical adapter 39. Cavities 41, 43 receive the fittings 45, 37, one each for the hose 19 and adapter body 35, and a liquid flow passage 47 extends between the cavities 41, 43 so that liquid from the hose 19 is delivered to the nozzle member 11.

The adapter 39 has an outside diameter selected to fit within the member 31 with sliding clearance and at its distal end 33, the adapter 39 has an enlarged stop shoulder 49 abutting the member 31. An outwardly spring-biased button 51 protrudes through and "locks" into a hole 53 in the member 31. A screw 55 is also provided for secure adapter/member attachment.

The hose 19 extends within the first and second tubular members 13, 31 and by the means described above, is connected to and in liquid-flow communication with the nozzle member 11. The hose 19 extends unbroken along the length of the first and second tubular members 13, 31, from the proximal end 15 of the first member 13 to the distal end 33 of the second member 31. Such arrangement provides cleaning solution discharge from the nozzle member 11 regardless of relative positions of the tubular members 13, 31 one to the other.

From the foregoing, it will be appreciated that the quantity of relatively heavy cleaning solution confined within the members 13, 31 is small, only that within the relatively small diameter hose 19. The weight of the device 10 is thereby minimized and the device 10 is very easy and less-tiring to manipulate, even over long periods of time. And such device 10 is devoid of hard-to-maintain sliding, dynamic seals as would otherwise be needed if pressurized liquid entirely filled the device 10.

In using the improved device 10, it is usually desirable to first adjust and then "lock" the overall length of the telescoped members 13, 31. In that Way, the user can select the best length for the particular cleaning conditions involving, e.g., a high or low ceiling. To that end, the device 10 includes means 59 such as a twist-type locking collar 59*a* to hold the tubular members 13, 31 together at a selected length of extension. To adjust the length of the device 10, the collar 59*a* is loosened, the device 10 extended or retracted as required, and the collar 59*a* re-tightened. And since in the preferred device 10, both members 13, 31 have smooth relatively sliding surfaces unbroken by position-selecting notches, grooves or the like, the tubular members 13, 31 may be secured together at an infinite number of relative positions. In other words, the overall length of the members 13, 31 is adjustable in a continuum rather than in discrete increments.

In cleaning operations, it is preferred that the user of the device 10 be able "meter" the flow of liquid and turn it on and off. And the members 13, 31 alone may not have sufficient length (even when fully extended) for some tasks.

Therefore, the device 10 further includes an elongate, tube-like base member 61 having a slightly "necked down" output end 63 of a diameter somewhat less than that of the main tube 65. An adapter 67 fits into the end 63 with sliding clearance, is held in place by a screw 55 and includes fitting cavities 69, 71 and a flow passage 73 extending between the cavities 69, 71. A disconnect fitting 29 and a barbed hose fitting 77 are received in the cavities 69 and 71, respectively. The adapter 67 has a spring-biased button 51 protruding laterally from the output end 63 and the purpose of this button 51 is described below.

The fittings 29, 37 are preferably of the normally-closed shutoff valve type with a plunger 79 depressed for opening as they engage the coupler 17 or the body 35, respectively. When the device 10 is partially disassembled or when the base member 61 is separated from the first member 13, the liquid in the hose 19 thereby remains "captured" and does not leak out onto the floor, carpet or the like.

The base member 61 has an input end 81 and a coupler 83 at such end 81 for attachment of a liquid supply line 85 from a pump. A valve 87 is mounted at the middle portion 89 of such base member 61 between the coupler 83 and the adapter 67. Lengths of coiled, flexible hose 19 connect the coupler 83 and the valve 87 and the valve 87 and the adapter 67. The valve 87 has a trigger member 91 manipulated by the user to control output of liquid. Convenient finger grooves 93 are provided for easy gripping and positive control as the member 91 is squeezed toward the main tube 65.

To connect the base member 61 and first member 13, the output end 63 of the member 61 is "plugged into" the proximal end 15 of the first tubular member 13 by sliding the output end 63 into the proximal end 15. The ends 15, 63 are then rotated one to the other until the base member button 51 aligns with and protrudes through a latch hole 95 in the proximal end 15, thus securing the ends 15, 63 together. When so arranged, the base member 61 provides a source of fluid to the hose 19 extending along the members 13, 31.

In cleaning situations requiring the user to "reach out" with a fully extended (or nearly fully extended) device 10, a good deal of the device weight is forward of the user's hands. Under those conditions, using the device 10 can be tiring. Therefore, the device also includes an annular, cylindrical donut-like weight member 97 removably secured to the base member 61 at its input end 81. The weight of the tubular members 13, 31 is thereby counterbalanced when the device 10 is gripped by the base member middle portion 89. The weight member 97 may not often be required since the weight of the line 85 (and, often, the tension on it) serve much the same purpose as a counterweight.

The need for user convenience is recognized in yet another aspect of the device 10. For "close-in" cleaning, users need not employ the entire device 10. Since the base member 61 is removably connected to the proximal end of the first tubular member 13, the member 61 may be removed, fitted with a spray nozzle and adapter body 35 and used alone for direct and nearby application of liquid. And for wall cleaning, the nozzle member 11 is removed and the device 10 is fitted with a glider adapter and wettable glider pad (not shown) in place of the nozzle member 11.

While the principles of this invention have been described in connection with specific embodiments, it should be understood clearly that these descriptions are made only by way of example and are not intended to limit the scope of the invention.

I claim:

1. In an extendable elongate liquid-applying device for cleaning inside surfaces such as walls and ceilings, the improvement comprising:

first and second tubular members telescopingly engaged with one another to extend and retract the device, a first coiled hose within the tubular members and extending therealong;

a base member having a second hose therewith and extending therealong, the base member being attached to the first tubular member, whereby only the first hose extends and retracts as the device is extended and retracted.

2. The device of claim 1 wherein the first tubular member has a proximal end and the first hose is secured to the proximal end.

3. The device of claim 2 wherein the base member includes a hollow tube having a valve therewithin for control of flow, the base member also including a valve trigger member exterior the tube for operating the valve.

4. The device of claim 3 wherein the base member further comprises:

an input end and an output end;

a middle portion intermediate the ends; and wherein:

the valve is at the middle portion.

5. The device of claim 3 wherein the second tubular member includes a detachable spray nozzle, the first tubular member has a proximal end, the base member is removably connected to the proximal end, and the spray nozzle is attachable to the base member whereby the base member may be removed and used alone for application of liquid.

6. In an extendable elongate liquid-applying device for cleaning inside surfaces such as walls and ceilings, the improvement comprising:

first and second tubular members telescopingly engaged with one another;

a base member attached to the first tubular member and having an input end with a hose coupler and an output end with an adapter;

a valve interior the base member and intermediate the ends; and, a pair of hoses interior the base member, the hoses and the valve comprising a flow path between the coupler and the adapter.

7. The device of claim 6 wherein the second tubular member includes a detachable spray nozzle adapted to be mountable to the output end of the base member whereby when the nozzle is mounted on the base member, the base member may be used alone for application of liquid.

8. The device of claim 7 further including a removable counterweight attached to the input end of the base member.

* * * * *